US005736011A

United States Patent [19]

Kade et al.

[11] Patent Number: 5,736,011

[45] Date of Patent: Apr. 7, 1998

[54] WET END ASSEMBLY FOR A PAPER MAKING MACHINE

[75] Inventors: Werner Kade, Neenah; Edwin X. Graf, Menasha, both of Wis.

[73] Assignee: Voith Sulzer Paper Technology North America, Inc., Appleton, Wis.

[21] Appl. No.: 682,331

[22] Filed: Jul. 17, 1996

[51] Int. Cl.[6] ..... D21F 9/02; D21F 1/00

[52] U.S. Cl. ..... 162/336; 162/301; 162/352; 162/344; 162/308; 162/306

[58] Field of Search ..... 162/336, 300, 162/301, 302, 303, 304, 305, 306, 307, 308, 299, 252, 272, 342, 339, 344, 352, 351

[56] References Cited

U.S. PATENT DOCUMENTS

| | | | |
|---|---|---|---|
| 3,884,756 | 5/1975 | Gustafson | 162/300 |
| 4,867,847 | 9/1989 | Kade | 162/289 |
| 5,034,100 | 7/1991 | Sides | 162/306 |
| 5,259,929 | 11/1993 | Bubik et al. | 162/301 |
| 5,277,765 | 1/1994 | Graf et al. | 162/342 |
| 5,423,948 | 6/1995 | Graf et al. | 162/342 |
| 5,554,267 | 9/1996 | Grossmann et al. | 162/301 |
| 5,578,172 | 11/1996 | Graf | 162/344 |

FOREIGN PATENT DOCUMENTS

| | | | |
|---|---|---|---|
| 1145229 | 3/1969 | United Kingdom | 162/336 |

*Primary Examiner*—Peter Chin
*Assistant Examiner*—Jose S. Fortuna
*Attorney, Agent, or Firm*—Taylor & Associates, P.C.

[57] ABSTRACT

The invention is directed to a wet end assembly disposed at a wet end of a paper making machine for forming a fiber web from a fiber suspension. A headbox including a plurality of inner walls defines a chamber. The headbox further includes an inlet in communication with the chamber for receiving the fiber suspension and a discharge nozzle in communication with the chamber for discharging the fiber suspension. The headbox further includes structure, engaged with the inner walls, for selectively and adjustably compensating for deflections of the inner walls. A former includes a moving top endless wire and a moving bottom endless wire, with the top endless wire and the bottom endless wire defining a converging gap therebetween. The converging gap has an entrance end positioned adjacent the discharge nozzle for receiving the fiber suspension therefrom. A press section includes a suction roll carrying an endless belt. The suction roll is positioned adjacent the top endless wire whereby the fiber suspension is transferred from a bottom of the top endless wire to a top of the endless belt.

19 Claims, 2 Drawing Sheets

WET END ASSEMBLY FOR A PAPER MAKING MACHINE

BACKGROUND OF THE INVENTION

1. Field of the Invention

The present invention relates to paper making machines, and, more particularly, to a wet end assembly for use at a wet end of a paper making machine.

2. Description of the Related Art

A paper making machine includes a portion at one end thereof which receives the prepared fiber suspension for processing into a fiber web. The portion of the paper making machine which receives the fiber suspension is commonly termed the "wet end" of the machine. The wet end of the machine may include a headbox and a forming section. The headbox receives the prepared fiber suspension and discharges the fiber suspension with a known cross-sectional profile to the forming section. The forming section begins to form the fiber web from the fiber suspension received from the headbox.

One known type of headbox is a hydraulic headbox. Such a headbox generates microturbulance within the fiber suspension by flow expansion losses which occur because of the particular geometry thereof. These expansion losses inhibit flocculation within the fiber suspension, which is an undesirable characteristic. A limitation with such headboxes is that they operate over a relatively narrow operating speed. For example, such hydraulic headboxes have a turn down ratio of between approximately 1.4:1 and 1.6:1. The turn down ratio is defined as the maximum flow rate of the fiber suspension through the headbox to the minimum flow rate of the fiber suspension through the headbox.

Another known type of headbox is a "Valley" headbox sold by the assignee of the present invention. Such a Valley headbox includes distributor rolls disposed within the chamber of the headbox for inducing microturbulance within the fiber suspension and preventing flocculation thereof. A pressurized air cushion above the fiber suspension level in the chamber also affects the flow characteristics of the fiber suspension through the headbox. Such headboxes produce a high quality fiber web, but typically operate at relatively slow operating speeds. If an air padded, distributor roll headbox is operated at higher speeds, the pressures within the box becomes such that deflection of the walls surrounding the chamber may result, with deleterious effects on the accuracy of the slice beam and slice lip disposed at the discharge outlet of the headbox. More particularly, deformation of the walls around the chamber of the headbox may result in deflections of the slice beam and/or slice slip, which in turn adversely effects the cross-sectional profile of the fiber suspension discharged from the headbox.

After passing through the wet end assembly, the fiber web is transferred to the press section of the machine. Typically, the press section includes a felt and the fiber web is transferred to the bottom side of the felt. A problem with such a configuration, however, is that for fiber webs having a basis weight of greater than approximately 110 pounds per 3000 square feet, the fiber web may fall off the traveling felt as a result of gravitational forces. To prevent such relatively heavy fiber webs from falling off the felt of the press section, it is known to use an additional felt which supports the bottom side of the fiber web and thereby prevents the fiber web from falling away from the felt.

What is needed in the art is a wet end assembly for a paper making machine which may be adjusted on the run, used over a large range of basis weight fiber webs, and operated over a relatively large operating speed range.

SUMMARY OF THE INVENTION

The present invention provides a wet end assembly including a headbox which is operable over a wide operating range and a press section which reliably receives a fiber web having a heavy basis weight from a former.

The invention comprises, in one form thereof, a wet end assembly disposed at a wet end of a paper making machine for forming a fiber web from a fiber suspension. A headbox including a plurality of inner walls defines a chamber. The headbox further includes an inlet in communication with the chamber for receiving the fiber suspension and a discharge nozzle in communication with the chamber for discharging the fiber suspension. The headbox further includes structure, engaged with the inner walls, for selectively and adjustably compensating for deflections of the inner walls. A former includes a moving top endless wire and a moving bottom endless wire, with the top endless wire and the bottom endless wire defining a converging gap therebetween. The converging gap has an entrance end positioned adjacent the discharge nozzle for receiving the fiber suspension therefrom. A press section includes a suction roll carrying an endless belt. The suction roll is positioned adjacent the top endless wire whereby the fiber suspension is transferred from a bottom of the top endless wire to a top of the endless belt.

An advantage of the present invention is that the wet end assembly is operable over a relatively large operating range and basis weight range.

Another advantage is that deflections of the walls of the headbox adjacent the chamber are inhibited.

Yet another advantage is that a fiber web having a relatively heavy basis weight can be effectively transferred from the former to the press section with little or no chance of the fiber web falling from the press section.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF TEE INVENTION

Figure 1:
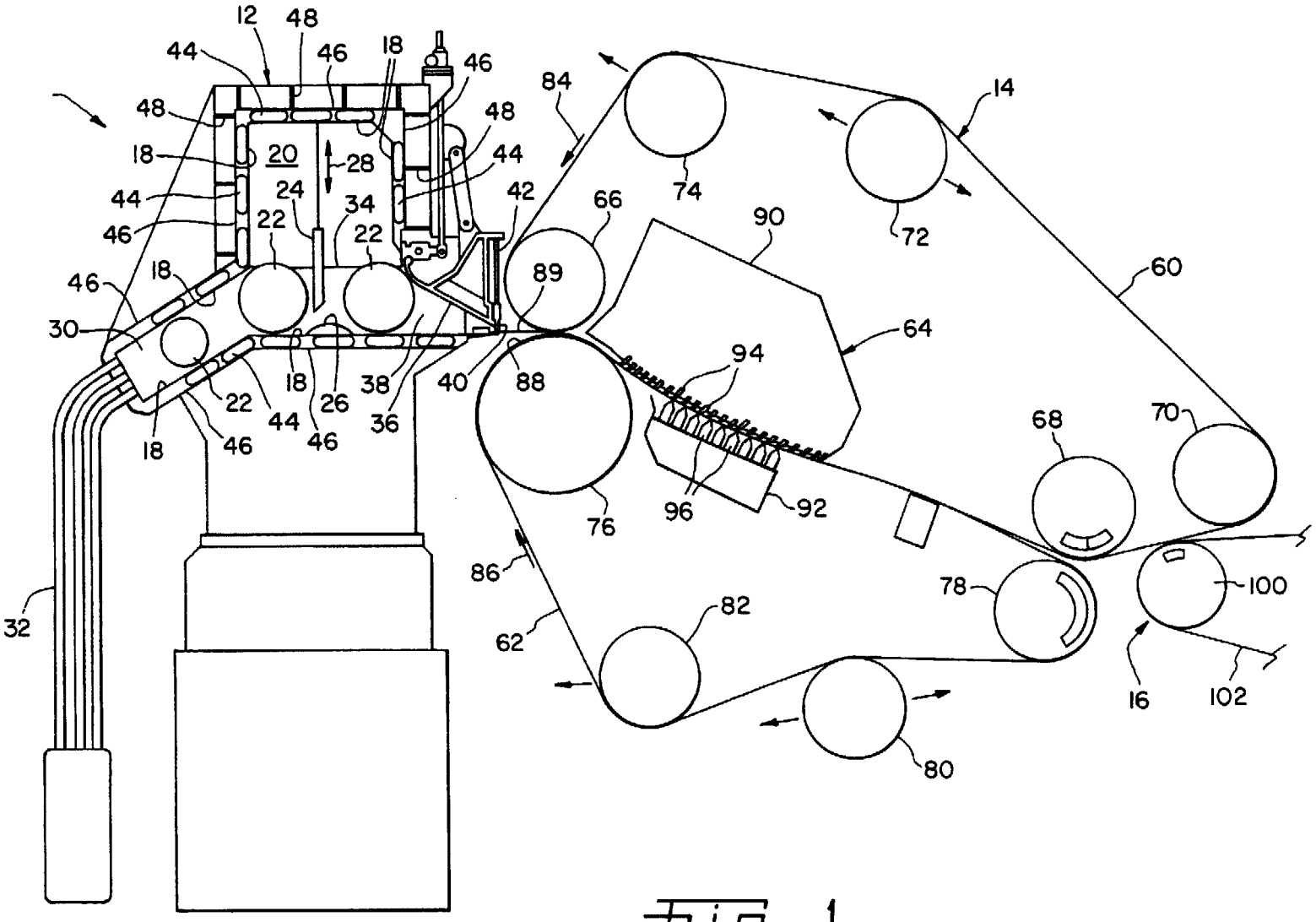
FIG. 1 is a schematical, side view of an embodiment of a wet end assembly of the present invention.

Referring now to the drawings, and more particularly to FIG. 1, there is shown an embodiment of a wet end assembly 10 of the present invention which defines a part of and is disposed at a wet end of a paper making machine for forming a fiber web (such as a paper web) from a fiber suspension. Wet end assembly 10 is operable to produce a fiber web having a basis weight range of between approximately 11 pounds per 3000 square feet and 300 pounds per 3000 square feet. Moreover, wet end assembly 10 has a turn down ratio of at least 3.5 to 1, with the turn down ratio being a ratio between a maximum flow rate therethrough and a minimum flow rate therethrough. In a more preferred embodiment, wet end assembly 10 has a turn down ratio of approximately 4⅜ to 1. Wet end assembly 10 generally includes a headbox 12, former 14 and press section 16 of which a portion is shown.

Headbox 12 is adaptable for use over a wide range of operating speeds and fiber suspension basis weights. Headbox 12 includes a plurality of inner walls 18 which define a chamber 20 therein. Inner walls 18, in the embodiment shown, have a thickness of between approximately 0.030 and 1.000 inch. Disposed within chamber 20 are a plurality of distributor rolls 22, and an optional auxiliary slice 24 and threshold 26. Distributor rolls 22 are rotatably carried by opposing side, inner walls 18. Auxiliary slice 24 is movable in a vertical direction, as indicated by arrow 28, and is inserted into the fiber suspension flow during low flow rate conditions. Auxiliary slice 24 and threshold 26 coact with each other during low flow rate conditions to induce microturbulance within the fiber suspension flow and thereby inhibit flocculation of the fiber suspension. For details of such structure, reference is hereby made to U.S. Pat. No. 5,277,765 (Graf), which is assigned to the assignee of the present invention and incorporated herein by reference.

Inner walls 18 of headbox 12 also define an inlet 30 which is disposed in fluid communication with chamber 20. Inlet 30 receives the fiber suspension from tube bundle 32, as is known. The fiber suspension introduced into headbox 12 through inlet 30 has a flow level 34 within chamber 20. The area of chamber 20 above flow level 34 is an air space which is pressurized to a predetermined operating pressure through the use of appropriate structure (not shown), as is known.

Headbox 12 also includes a slice beam 36 which together with the bottom, inner wall 18 define a discharge nozzle 38. A slice lip 40 disposed at the outlet of discharge nozzle 38 is adjustable in a vertical direction across the length thereof using a plurality of spindles attached thereto, one of which is shown and referenced 42 in FIG. 1. Coarse adjustment of discharge nozzle 38 may be achieved by pivotally moving slice beam 36, as is known. Discharge nozzle 38 and slice lip 40 are thus adjusted to discharge a predetermined amount of the fiber suspension from headbox 12.

Figure 2:
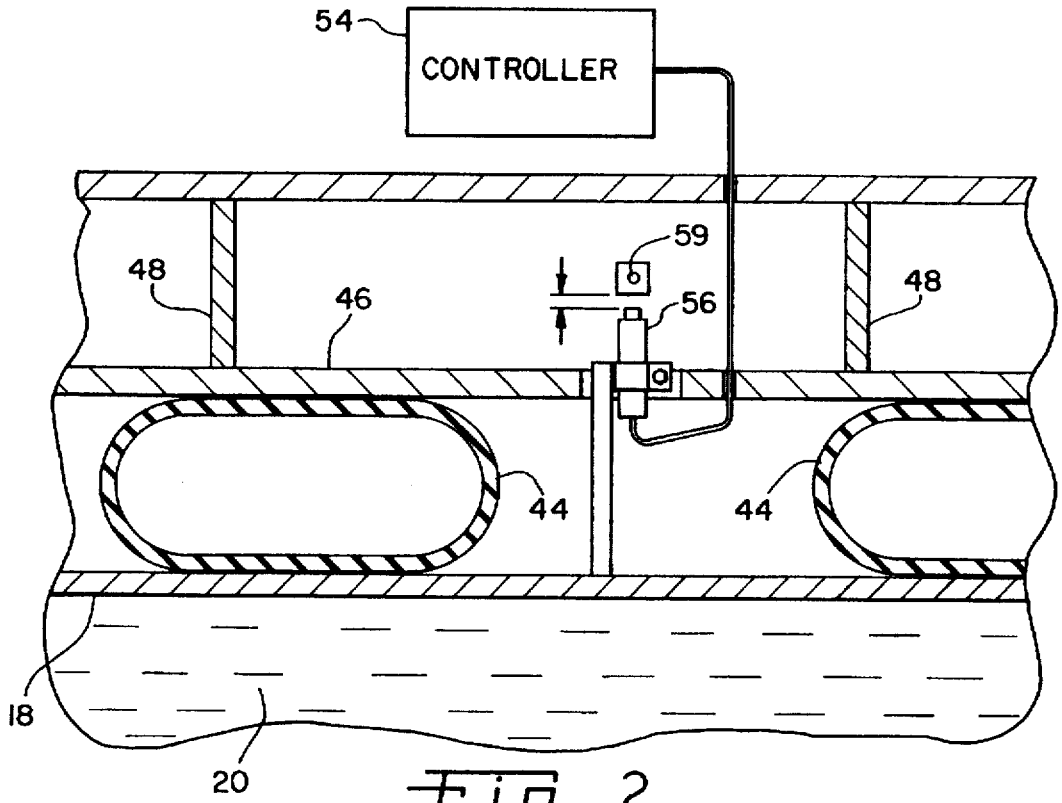
FIG. 2 is an enlarged, fragmentary view of a portion of the headbox shown in FIG. 1.

According to one aspect of the present invention, and referring to FIGS. 1 and 2, headbox 12 is configured to inhibit deflections of inner walls 18 during operation caused by the fiber suspension flowing therethrough and the pressurized air within chamber 20. Such deflections of inner walls 18 are undesirable because they in turn may cause deflections of slice beam 36, slice lip 40 and/or bottom, inner wall 18 which would affect the cross-sectional profile of the fiber suspension which is discharged from headbox 12. In particular, headbox 12 includes a plurality of inflatable and deflatable air loading tubes 44 which are disposed between inner walls 18 and a plurality of corresponding outer walls 46. Outer walls 46 are positioned generally parallel to inner walls 18, and may themselves be inhibited from deflecting by the use of reinforcing ribs 48.

Figure 3:
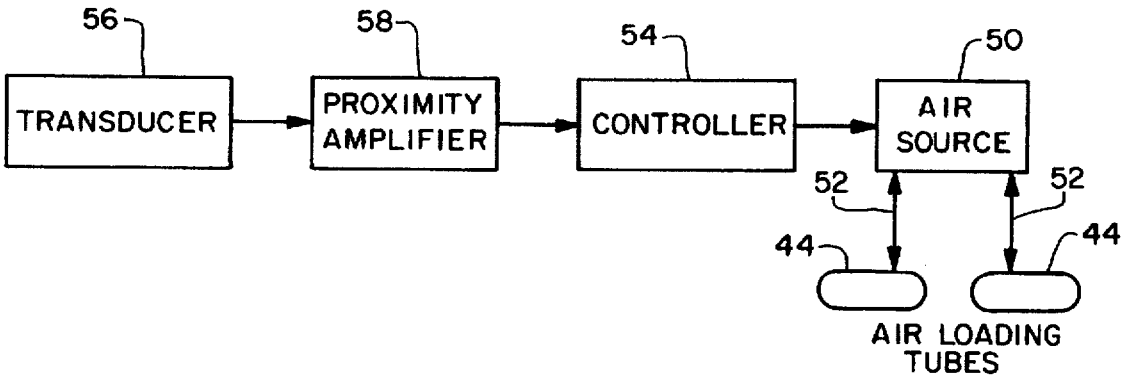
FIG. 3 is a block diagram illustrating a method of controlling the air loading tubes within the headbox shown in FIGS. 1 and 2.

Referring to FIG. 3, air loading tubes 44 compensate for deflections of inner walls 18, and are fluidly connected to an air source 50 (not shown in FIGS. 1 and 2) via fluid lines 52. Air loading tubes 44 have an operating pressure therein which is sufficient to offset the operating pressure within chamber 20 (e.g., 20 to 100 psi in the embodiment shown). Air source 50 selectively effects both inflation and deflation of air loading tubes 44, such that selected loads may be placed at various locations on inner walls 18 to inhibit deflections thereof. Air source 50 is controlled by a controller 54 for inflating and deflating selected air loading tubes 44. Controller 54 receives signals from a plurality of sensors in the form of inductive proximity transducers 56 which are positioned at predetermined locations associated with inner walls 18. Sensors 56, one of which is shown in FIG. 2, provide signals indicative of deflections of inner walls 18 to controller 54. Since inner walls 18 and outer walls 46 may each deflect somewhat during operation, proximity sensors 56 may be positioned relative to a metallic target which tautly extends between the sidewalls of headbox 12, thereby providing a more accurate indication of the deflections of inner walls 18. In the embodiment shown, proximity sensors 56 are positioned relative to a metallic rod 59 which extends between the sidewalls of headbox 12. An amplifier 58 may also be provided between sensors 56 and controller 54 for amplifying the sensor signals which are provided to controller 54. Controller 54 converts the amplified inductance values provided by sensors 56 to corresponding pressures within the selected air loading tubes 44, and controls air source 50 to effect the selected pressures within air loading tubes 44.

Former 14 is in the form of a gap former which generally includes a top endless wire 60, a bottom endless wire 62 and a blade unit 64. Top endless wire 60 is rotatably carried by a plurality of rolls 66–74, with rolls 72 and 74 being adjustable as shown by the associated directional arrows for tensioning top endless wire 60. Similarly, bottom endless wire 62 is rotatably carried by rolls 76–82, with rolls 80 and 82 being adjustable as shown by the associated arrows for tensioning of bottom endless wire 62. Top endless wire 60 and bottom endless wire 62 rotate towards each other as indicated by arrows 84, 86 and define a converging gap therebetween with an entrance end 88 positioned adjacent to the outlet of discharge nozzle 38 for receiving the fiber suspension 89 which is discharged therefrom. The fiber suspension 89 is received in the converging gap at entrance end 88 and is squeezed between top endless wire 60 and bottom endless wire 62.

Blade unit 64 is positioned adjacent to the converging gap formed between top endless wire 60 and bottom endless wire 62. Blade unit 64 includes an upper dewatering box 90 and a lower forming box 92. Upper dewatering box 90 includes a plurality of ceramic elements 94 which are positioned against top endless wire 60 on a side thereof which is opposite from the fiber suspension passing through former 14. Similarly, lower forming box 92 includes a plurality of ceramic elements 96 which are positioned against bottom endless wire 62 on a side thereof which is opposite from the fiber suspension passing through former 14. Ceramic elements 94, 96 form a converging gap with a slight zig-zag pattern which creates pressure pulses and shear forces in the fiber suspension passing therebetween. At the discharge end of former 14 is a two-zone suction roll 68 associated with top endless wire 60, and a suction couch roll 78 associated with bottom endless wire 62.

Press section 16 is shown only partially in FIG. 1. In particular, the portion of press section 16 which transfers the fiber web from former 14 to press section 16 is shown. Press section 16 includes a suction roll 100 which rotatably carries an endless belt 102 in the form of an endless felt. According to another aspect of the present invention, suction roll 100 and endless felt 102 are positioned relative to former 14 such that a fiber web having a relatively heavy basis weight can be effectively transferred from former 14 to press section 16 without the use of additional supporting felts, etc. To wit, suction roll 100 and felt 102 are positioned below and adjacent to top endless wire 60, whereby the fiber web is transferred from a bottom of top endless wire 60 to a top of endless felt 102. This is in contrast with conventional configurations which transfer the fiber web from the top of an endless wire of former 14 to the bottom of an endless felt of the press section. The use of suction rolls 68 and 100, in addition to the positioning of felt 102 below top endless wire 60, allows the transfer of a heavy basis weight fiber web to press section 16 by effectively overcoming the effects of gravity on the fiber web at the transfer location. Two-zone suction roll 68 is positioned adjacent to and upstream from suction roll 100 of press section 16, relative to the direction of travel 84 of top upper wire 60.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wet end assembly disposed at a wet end of a paper making machine for forming a fiber web from a fiber suspension, said wet end assembly comprising:

a headbox including a plurality of inner walls defining a chamber, said headbox further including an inlet in communication with said chamber for receiving the fiber suspension and a discharge nozzle in communication with said chamber for discharging the fiber suspension, said headbox further including means, engaged with each of said inner walls, for selectively and adjustably compensating for deflections of each of said inner walls;

a former configured to begin forming the fiber web from the fiber suspension, said former including a moving top endless wire and a moving bottom endless wire, said top endless wire and said bottom endless wire defining a converging gap therebetween, said converging gap having an entrance end positioned adjacent said discharge nozzle for receiving the fiber suspension therefrom; and a press section including a suction roll carrying an endless belt, said suction roll positioned adjacent said top endless wire whereby the fiber suspension is transferred from a bottom of said top endless wire to a top of said endless belt.

2. The wet end assembly of claim 1, wherein said suction roll of said press section is positioned below and adjacent to said top endless wire.

3. The wet end assembly of claim 1, wherein said endless belt comprises an endless felt.

4. The wet end assembly of claim 1, wherein the fiber suspension is received in the converging gap from said discharge nozzle and is squeezed between said top endless wire and said bottom endless wire.

5. The wet end assembly of claim 1, wherein said former further comprises a blade unit positioned adjacent to said converging gap.

6. The wet end assembly of claim 5, wherein said blade former further comprises an upper dewatering box and a lower forming box, said upper dewatering box including a plurality of ceramic elements positioned against said top endless wire on a side thereof opposite said fiber suspension and said lower forming box including a plurality of ceramic elements positioned against said bottom endless wire on a side thereof opposite said fiber suspension.

7. The wet end assembly of claim 1, wherein said headbox further comprises at least two distributor rolls rotatably carried by said inner walls and disposed within said chamber.

8. The wet end assembly of claim 7, wherein said headbox further comprises an auxiliary slice disposed within said chamber and between two of said distributor rolls.

9. The wet end assembly of claim 1, wherein said wet end assembly is operable to produce a fiber web having a basis weight range between approximately 11 pounds per 3000 square foot and 300 pounds per 3000 square foot.

10. The wet end assembly of claim 1, wherein said wet end assembly has a turn down ratio of at least 3.5 to 1, said turn down ratio being a ratio between a maximum flow rate through said wet end assembly and a minimum flow rate through said wet end assembly.

11. The wet end assembly of claim 10, wherein said wet end assembly has a turn down ratio of approximately 4⅜ to 1.

12. A wet end assembly disposed at a wet end of a paper making machine for forming a fiber web from a fiber suspension, said wet end assembly comprising:

a headbox including a plurality of inner walls defining a chamber, said headbox further including an inlet in communication with said chamber for receiving the fiber suspension and a discharge nozzle in communication with said chamber for discharging the fiber suspension, said headbox further including means, engaged with each of said inner walls, for selectively and adjustably compensating for deflections of each of said inner walls, said headbox further including a plurality of outer walls disposed in spaced apart relationship from said inner walls, and wherein said compensating means comprises a plurality of inflatable and deflatable air loading tubes disposed between said inner walls and said outer walls;

a former configured to begin forming the fiber web from the fiber suspension, said former including a moving top endless wire and a moving bottom endless wire, said top endless wire and said bottom endless wire defining a converging gap therebetween, said converging gap having an entrance end positioned adjacent said discharge nozzle for receiving the fiber suspension therefrom; and a press section including a suction roll carrying an endless belt, said suction roll positioned adjacent said top endless wire whereby the fiber suspension is transferred from a bottom of said top endless wire to a top of said endless belt.

13. In a paper making machine, a headbox comprising:

a plurality of inner walls defining a chamber;

a plurality of outer walls disposed in spaced apart relationship from said inner walls;

a plurality of sensors positioned at predetermined locations associated with said inner walls for sensing deflections of said inner walls and providing signals indicative thereof;

a plurality of inflatable and deflatable air loading tubes disposed between said inner walls and said outer walls; and a controller connected to each of said sensors and receiving said sensor signals, said controller further being connected to each of said air loading tubes for inflating and deflating selected ones of said air loading tubes, dependent upon said received sensor signals.

14. The headbox of claim 13, wherein each of said sensors comprise an inductive proximity sensor.

15. The headbox of claim 14, and further comprising a plurality of metallic targets, separate from said inner walls, associated with said plurality of sensors.

16. The headbox of claim 15, wherein said plurality of metallic targets comprise a plurality of wires.

17. The headbox of claim 13, wherein said plurality of sensors comprise inductive proximity sensors and said sensor signals correspond to inductance values, and wherein said controller converts said inductance values to corresponding pressures within said selected ones of said air loading tubes.

18. The headbox of claim 17, further comprising an air source interconnecting said controller with each of said air loading tubes.

19. The headbox of claim 13, wherein said headbox further comprises a discharge nozzle in communication with said chamber and a slice lip positioned at said discharge nozzle, said plurality of outer walls and said plurality of air loading tubes inhibiting deflections of said plurality of inner walls, and thereby inhibiting deflections of said slice lip.

* * * * *